US010307756B2

(12) United States Patent
Marques Caleiro Cabeça et al.

(10) Patent No.: US 10,307,756 B2
(45) Date of Patent: Jun. 4, 2019

(54) CAPILLARY JUNCTION

(71) Applicant: BIOSURFIT, S.A., Aveiro (PT)

(72) Inventors: Ricardo Manuel Marques Caleiro Cabeça, Aveiro (PT); André Do Rosário Magalhães, Aveiro (PT); Andreia Andrade Dos Santos, Aveiro (PT); Sandra Cristina Sarmento Donato Dos Santos E Silva, Aveiro (PT); João Manuel De Oliveira Garcia Da Fonseca, Aveiro (PT)

(73) Assignee: Biosurfit, S.A., Aveiro (PT)

( * ) Notice: Subject to any disclaimer, the term of this patent is extended or adjusted under 35 U.S.C. 154(b) by 0 days.

(21) Appl. No.: 15/928,215

(22) Filed: Mar. 22, 2018

(65) Prior Publication Data

US 2018/0207636 A1 Jul. 26, 2018

Related U.S. Application Data

(63) Continuation of application No. 15/532,086, filed as application No. PCT/PT2016/050013 on Jun. 17, 2016, now abandoned.

(30) Foreign Application Priority Data

Jun. 19, 2015 (GB) ..... 1510875.6

(51) Int. Cl.

| | |
|---|---|
| ***B01L 99/00*** | (2010.01) |
| ***B01L 3/00*** | (2006.01) |
| ***F04B 19/00*** | (2006.01) |

(52) U.S. Cl.

CPC ..... *B01L 3/502723* (2013.01); *B01L 3/50273* (2013.01); *B01L 3/502746* (2013.01); *F04B 19/006* (2013.01); *B01L 2200/0621* (2013.01); *B01L 2300/0816* (2013.01); *B01L 2300/0864* (2013.01); *B01L 2400/0406* (2013.01); *B01L 2400/0688* (2013.01)

(58) Field of Classification Search

CPC ..... B01L 2400/0688

See application file for complete search history.

(56) References Cited

U.S. PATENT DOCUMENTS

2005/0249641 A1* 11/2005 Blankenstein .... B01L 3/502738 422/400

2011/0053289 A1* 3/2011 Lowe ..... B01L 3/5027 436/501

* cited by examiner

*Primary Examiner* — Paul S Hyun

(74) *Attorney, Agent, or Firm* — Patterson Thuente Pedersen, P.A.

(57) ABSTRACT

A microfluidic device with reduced risk of bubble formation at a capillary junction between two conduits is provided. In some embodiments, the microfluidic device comprises a supply reservoir, a first conduit and a second conduit. The first conduit is configured such that liquid flows by capillary effect from the supply reservoir into the first conduit. The second conduit is connected to the first conduit through an opening in a wall of the first conduit and is configured such that liquid flows from the first conduit to the second conduit by capillary effect. A width of the second conduit, along a direction of liquid flow in the first conduit, is greater than a depth of the second conduit and a depth of the second conduit is less than a depth of the first conduit.

13 Claims, 3 Drawing Sheets

CAPILLARY JUNCTION

RELATED APPLICATIONS

This application is a continuation of application Ser. No. 15/532,086 filed May 31, 2017, which is a National Phase entry of PCT Application No. PCT/PT2016/050013, filed Jun. 17, 2016, which claims priority from Great Britain Application No. 1510875.6, filed Jun. 19, 2015, the disclosures of which are hereby incorporated by referenced herein in their entirety.

FIELD OF THE INVENTION

The present invention relates to a microfluidic device, for example a centrifugal microfluidic device, and, in particular, to a microfluidic device for controlling liquid flow at the junction between two conduits having different depths. The device may be a 'lab on a disc' device.

BACKGROUND

Microfluidic devices, such as 'lab on a disc' devices allow the sequencing and control of small volumes of liquid through conduits and chambers on the scale of micrometers to millimeters. Liquid may be caused to flow through such a microfluidic device under the action of centrifugal force, by rotating the device and controlling the frequency of rotation. Other options for inducing flow of a liquid through a microfluidic device include pressure-driven flow and capillary driven flow.

In the case of capillary driven flow, a way of ensuring that liquid flows through the required parts of the device is to narrow a flow path one or more times along its extent, as described in application EP13708496.8, incorporated herein by reference in its entirety. Capillary forces acting on a liquid in a conduit are greater the narrower the conduit and sequential narrowing of the flow path maintains capillary driven flow in the face of hydraulic resistance. Narrowing may be achieved by a reduction in depth of a conduit, by a reduction in width of a conduit, or both. The present application focuses on the situation in which a first conduit with a first depth is joined to a second conduit with a depth less than that of the first conduit in order to advance a liquid from the first conduit to the second by capillary effect.

SUMMARY

The present invention provides a microfluidic device with a junction between two conduits with differing depths, the junction being structured in such a way so as to control liquid flow in the region of the junction.

Aspects of the invention are set out in the independent claims. Further, optional, features of the invention are set out in the dependent claims.

In some embodiments, there is provided a microfluidic device comprising a supply reservoir and a first conduit. The first conduit is configured such that liquid flows by capillary effect from the supply reservoir into the first conduit. The device further comprises a second conduit connected to the first conduit through an opening in a wall of the first conduit and configured such that liquid flows from the first conduit into the second conduit by capillary effect. A width of the second conduit, along a direction of liquid flow in the first conduit, is greater than a depth of the second conduit and the depth of the second conduit is less than a depth of the first conduit.

By configuring the junction or intersection between a first and second conduit with differing depths as described above, a microfluidic device is provided in which flow of liquid in the region of the junction between the first and second conduits may be well defined to avoid, or reduce the risk of, bubble formation.

In particular, the claimed geometry facilitates that liquid from the first conduit consistently contacts the second conduit first at a corner to one side so that, subsequently, the continued flow in the first conduit across the opening aids filling of the junction, and hence the second conduit, across the width of the second conduit, thereby reducing the risk of air being trapped at the junction.

In some embodiments, the first conduit is vented. In particular, the first conduit may be vented downstream of the opening in the wall of the conduit. In some embodiments, the device comprises a first vent structure enabling gas in the first conduit displaced by flow of liquid from the supply reservoir into the first conduit to escape from the first conduit and back into the supply reservoir. In some embodiments, such a vent structure may comprise an air channel connecting the first conduit to the supply reservoir.

In some embodiments, the second conduit is vented. In particular, the second conduit may be vented downstream of the opening in the first wall of the conduit. In some embodiments, the device comprises a second vent structure enabling gas in the second conduit displaced by flow of liquid from the first conduit into the second conduit to escape from the second conduit and into the supply reservoir. In some embodiments, such a vent structure may comprise an air channel connecting the second conduit to the supply reservoir.

In some embodiments, one or more of the first conduit, the second conduit and the supply reservoir may be open to the atmosphere, for example via one or more valves. Alternatively, the device may comprise an internal air circuit, to which the first conduit, the second conduit and the supply reservoir are each connected.

In some embodiments, one or both of the first and second conduits are vented as described above. In some embodiments, one of the first and second conduits is not vented and in some embodiments, neither of the first and second conduits are vented. This will be explained in greater detail below, with reference to the drawings.

In some embodiments, a ratio between the depth of the first conduit upstream of the junction between the first and second conduits and the depth of the second conduit is greater than or equal to 3. Preferably, the ratio is 5 and more preferably the ratio is 10.

In some embodiments, the first conduit comprises a surface tension barrier downstream of a junction between the first and second conduits. A surface tension barrier may be implemented by configuring the dimensions of the first conduit. In some embodiments, a portion of the first conduit downstream of the opening in the wall of the first conduit has a transverse dimension greater than a depth of the first conduit upstream of the opening. In some embodiments, this dimension may be a depth of the first conduit downstream of the opening. In other words, a portion of the first conduit downstream of the opening has a depth greater than a depth of the first conduit upstream of the opening. Preferably, the depth increase is configured as a step. Advantageously, this encourages stopping of the flow in the first conduit once the second conduit has been filled across the opening.

Alternatively or additionally, the surface tension barrier may be facilitated by surface modification, for example by lining a portion of the first conduit downstream of the junction between the first and second conduits with a hydrophobic material. Additionally or alternatively, the portion of the first conduit upstream of the junction may be lined with a hydrophilic material.

In some embodiments, a ratio between the depth of the first conduit upstream of the junction between the first and second conduits and the depth of the aforesaid portion of the first conduit downstream of the junction between the first and second conduits is lower than or equal to 0.75. Preferably the ratio is 0.5 and more preferably the ratio is 0.25.

In some embodiments, the second conduit is substantially perpendicular to the first conduit. More generally, the second conduit may be oriented at a non-zero angle with respect to the first conduit.

In some embodiments, an aspect ratio of the second conduit, i.e. a ratio between the width of the second conduit and the depth of the second conduit is greater than or equal to 42.5. In some embodiments, the aspect ratio preferably is 60 and more preferably is 80. By selecting a sufficiently high aspect ratio for the second conduit, for example in line with the ratios set out above, control over liquid flow in the region of the junction between the first and second conduits is achieved, as discussed in greater detail below.

In some embodiments, at least one of the first and second conduits contains a dry reagent. Such reagents may include a haemolysing agent for selective lysis of erythrocytes in a blood sample flowing through the conduit and/or a staining agent for selectively staining leukocytes such a blood sample. One or both of the first conduit and the second conduit may, in some embodiments, contain a surfactant in dry form and/or a stabiliser agent in dry form.

In some embodiments, the second conduit is configured as a detection conduit in which liquid can be detected and/or imaged, for example, as it flows in the second conduit. An upper surface of the second conduit may be transparent so as to allow an imaging device to capture one or more images of the liquid as it flows through the conduit. For example, one or more images may be captured for the purpose of cell counting, which may include identifying cells as one of a plurality of cell types and counting the number of cells of one or more of the plurality of cell types. Such a method is described in UK patent application 1417178.9, incorporated herein by reference in its entirety.

In some embodiments, the device comprises a waste chamber in fluidic communication with the second conduit to receive the liquid once it has flowed through the second conduit. Additionally or alternatively, the device may comprise further microfluidic structures, such as conduits and chambers, to which the second conduit is connected, for further processing and/or analysis of liquid. The waste chamber or other structures may be configured to encourage capillary flow through the device.

For the avoidance of doubt, the term "microfluidic" is referred to herein to mean devices having a fluidic element such as reservoir or a channel with at least one dimension below 1 mm. The microfluidic device may comprise a disc-shaped cartridge, configured for insertion into an analysis device, optionally including an imager, such as a digital camera, for the purposes of imaging a liquid inside the cartridge. The analysis device may comprise a rotor for spinning the microfluidic device to cause centrifugally driven flow(s) in the microfluidic device in addition to capillary flow(s). The cartridge may also be of other shapes, for example a cuboid.

BRIEF DESCRIPTION OF THE FIGURES

The following description of specific embodiments is made by way of example and illustration and not limitation, with reference to the drawings in which.

DETAILED DESCRIPTION

Figure 1A:
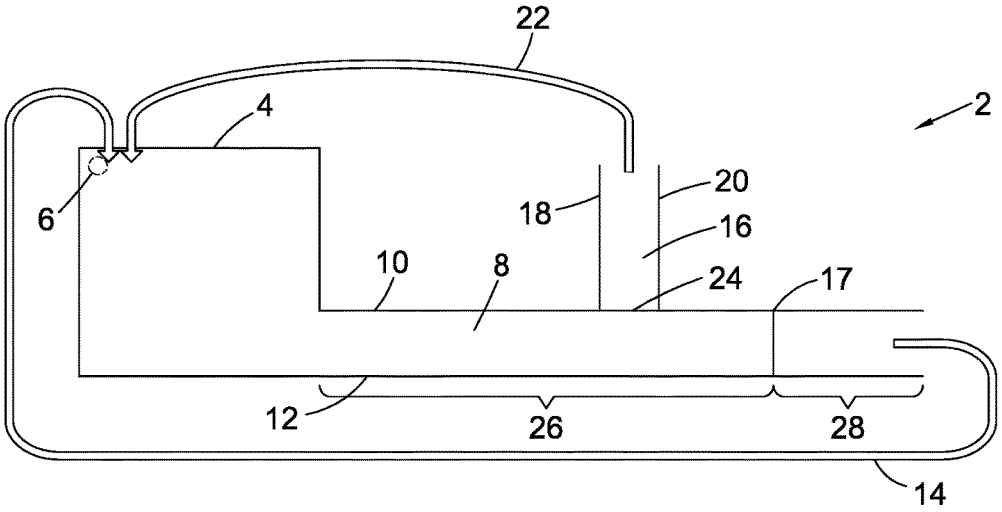
FIG. 1A illustrates schematically a microfluidic device in a first cross-section.
Figure 1B:
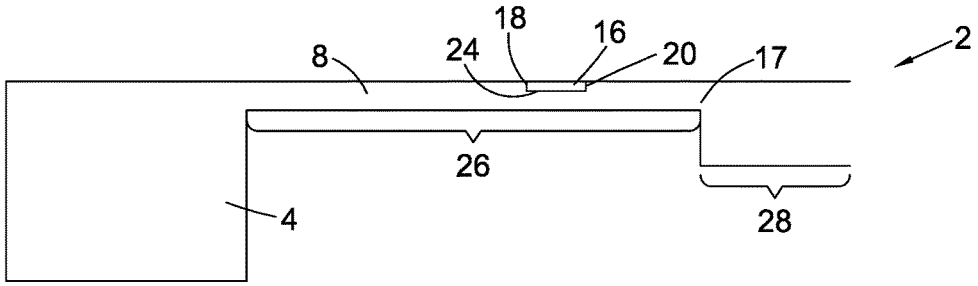
FIG. 1B illustrates schematically a second cross-section of the microfluidic device, perpendicular to that in FIG. 1A.

With reference to FIGS. 1A and 1B, a microfluidic device 2, in some embodiments a disc-shaped device arranged to drive liquid flow by rotating the disc, in addition to the capillary flows described below, comprises a supply reservoir 4 with an inlet 6, the location of which is illustrated with a dashed line. The supply reservoir 4 is in fluidic communication with a first conduit 8 with a depth of 200 μm and a width of 1 mm defined by a first wall 10 and a second wall 12. A first air flow structure illustrated schematically by an arrow 14 connects the first conduit 8 to the supply reservoir 4 such that gas in the first conduit which is displaced by flow of liquid from the supply reservoir 4 into the first conduit 8 can escape from the first conduit 8 and into the supply reservoir.

For the avoidance of doubt, the depths of the various microfluidic structures including the first and second conduits, as referred to herein, are measured perpendicular to a plane containing the first conduit 8 and a second conduit 16 (described below). The widths of the first and second conduits 8, 16, are measured in the plane, perpendicular to the direction of flow of liquid in the respective conduit.

The first conduit 8 is also in fluidic communication with a second conduit 16 which has a depth of 20 μm and a width of 850 μm defined by a first wall 18 and a second wall 20. A second air flow structure is illustrated schematically by an arrow 22 and connects the second conduit 16 to the supply reservoir 4 such that gas in the second conduit which is displaced by flow of liquid from the first conduit 8 into the second conduit 16 can escape from the second conduit 16 and into the supply reservoir 4.

The second conduit 16 connects to the first conduit 8 through an opening 24 in the wall 10 and extends perpendicularly from the wall 10. The wall 10 in the region of the opening 24 forms a step change in flow depth between the first and second conduits 8, 16. In some embodiments, the change may be more gradual and may comprise a series of steps or a sloping portion.

The second conduit 16 is thus connected to the first conduit 8 through the wall 10 of the first conduit 8, extending from the side of the first conduit. Due to the difference in depth, liquid in the first conduit flows into the second conduit by capillary effect.

The first conduit 8 comprises a first portion 26 and a second portion 28. The second portion 28 of the first conduit 8 is downstream of the opening 24 and has a depth of 300 μm. At the boundary between the first portion 26 and the second portion 28 of the first conduit, the depth of the conduit changes in one step, forming a surface tension barrier to flow. Liquid is not able to flow past the surface tension barrier, under the action of capillary forces, but air is able to move past the barrier and is vented out of the first conduit 8 via the first vent structure, as indicated with arrow 14. The surface tension barrier therefore also helps to reduce the risk of the air flow structure 14 becoming clogged with liquid.

In some embodiments, instead of being located downstream of the opening 24, the step 16 is located at the downstream end of the opening 24.

Liquid flows within the microfluidic device will now be described with reference to FIGS. 2A-C.

Initially, a liquid 30 is introduced into the device via the inlet 6. This may be done by a user with a pipette or capillary tube, for example. The liquid may be a blood sample, but in other embodiments may be serum or aqueous solutions. Liquid enters the supply reservoir 4 via the inlet 6 and subsequently flows into the first conduit 8.

Figure 2A:
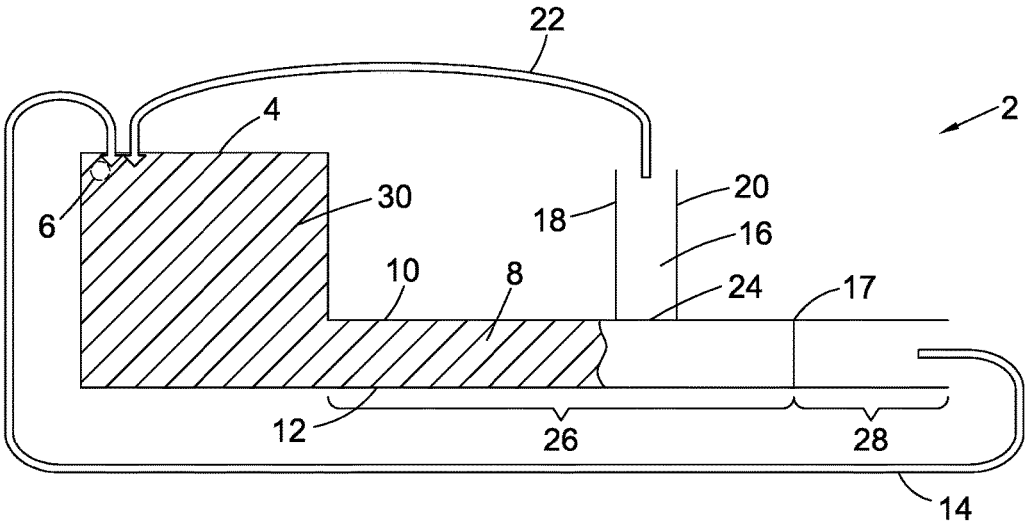
FIGS. 2A-C illustrate schematically the operation of the microfluidic device.
Figure 2B:
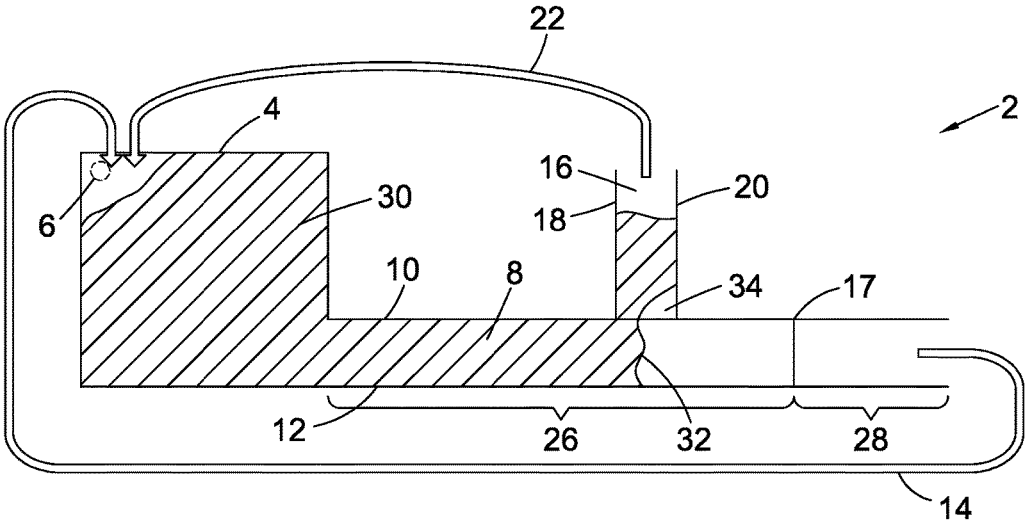

Once liquid has entered the first conduit 8, it flows along the first conduit 8 until it reaches the opening 24, as illustrated in FIG. 2A. Since the second conduit 16 extends off from a side of the first conduit 8, a liquid front 32 of the liquid 30 travelling along the first conduit 8 first encounters the second conduit 16 in a well-defined location at the upstream corner of the opening 24 between the walls 10, 18. As illustrated in FIG. 2B, as the liquid front 32 advances in the first conduit 8, the surface tension of the liquid encourages the integrity of the liquid front 32 and the advance of the liquid front 32 in the first conduit 8 causes the second conduit 16 to be filled from the wall 18 to the wall 20 in a controlled manner as the liquid front 32 is drawn across the opening 24 by its advance in the first conduit 8. While the liquid front 32 is drawn across the opening 24, a volume of air 34 in the second conduit 16 between the liquid 30 and the opening 24 remains connected to the air flow structure 14 through the first conduit 8, thereby venting any bubble that may otherwise form in the second conduit 16 through the first conduit 8.

Figure 2C:
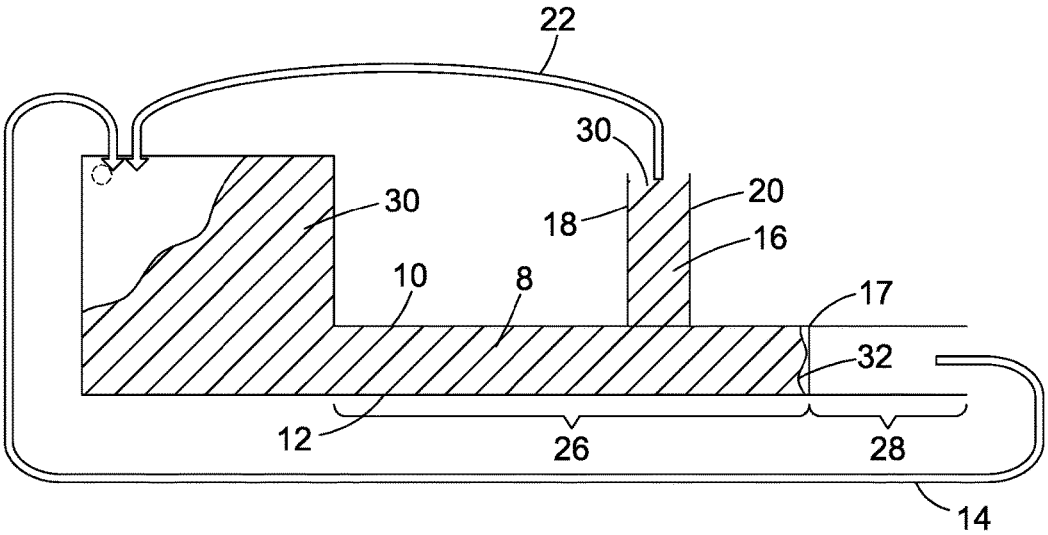

Referring now to FIG. 2C, liquid proceeds to fill the entire width of the second conduit 16 and flows along it. Liquid 30 also continues to flow in the first conduit 8 after the integrity of the liquid front 32 (due to surface tension) has forced all, or at least some, of any air present in the second conduit 16 and the opening 24 to vent via the air flow structure 14. As the liquid continues to flow along the first conduit 8 it reaches the step 16, acting as a barrier to capillary flow to stop liquid flowing into the portion 28 of the first conduit. In this way, the majority of the volume of liquid that is transferred from the supply reservoir 4 to the first conduit 8 is directed into the second conduit 16, rather than continuing down the first conduit 8.

In some embodiments, the second conduit 16 is configured as a detection conduit. An upper surface of the second conduit 16 is transparent so as to allow an imaging device to capture one or more images of the liquid as it flows through the second conduit 16.

In some embodiments, one or both of the first conduit and the second conduit may contain one or more dry reagents. Such reagents may include a haemolysing agent for selective lysis of erythrocytes in a blood sample flowing through the conduit and/or a staining agent for selectively staining leukocytes in such a blood sample.

One or both of the first conduit and the second conduit may, in some embodiments, contain a surfactant in dry form and/or a stabiliser agent in dry form.

While specific embodiments have been described above for illustration, many variations, alterations and juxtapositions of the specific features in addition to those specifically mentioned above, will occur to the skilled reader upon reading the description and are within the scope of the present disclosure and of the appended claims. For example, capillary flow of a liquid through a conduit may be enhanced or facilitated by lining the conduit with hydrophilic material or by constructing the conduit out of hydrophilic material. Likewise, the surface tension barrier can be implemented by hydrophobic surface modification rather than by virtue of the shape of the conduit.

Other configurations with regards to the venting of the first and second conduits 8, 16 are also possible. In the embodiment described above, with reference to FIGS. 1A and 1B and also 2A-C, the device 2 comprises first air flow structure illustrated schematically by an arrow 14, which connects the first conduit 8 to the supply reservoir 4 such that gas in the first conduit which is displaced by flow of liquid from the supply reservoir 4 into the first conduit 8 can escape from the first conduit 8 and into the supply reservoir.

Venting the first conduit may be advantageous in that it enables gas displaced by flow of liquid from the supply reservoir 4 into the first conduit 8 to escape the first conduit 8, instead of becoming trapped in the first conduit, in particular in the region of the junction between the first 8 and second 16 conduits. By avoiding, or at least minimising the risk of, trapped gas at the junction between the two conduits 8, 16, there is a reduced risk of liquid entering the second conduit 16 without filling the second conduit across its entire width at the opening 24, thus reducing the effective cross-section of the second conduit.

In some embodiments, the first conduit 8 is not vented. In this case, as liquid flows from the supply reservoir 4 into the first conduit 8, gas present in the first conduit 8 is pushed along it and as the liquid flows, the gas pressure at the end of the first conduit increases. It will be appreciated that there will come a point at which the capillary forces acting on the liquid, drawing it along the first conduit, will be balanced by the gas pressure at the end of the first conduit. Accordingly, the liquid front in the first conduit will reach an equilibrium position. Provided that this equilibrium position is downstream of the opening, the second conduit will fill with liquid across its full width and liquid will flow from the first conduit 8 and into the second conduit 16 freely. In the absence of a vent for the first conduit, the first conduit is, in some embodiments, configured such that its volume downstream of the opening 24 is sufficiently large so as to contain the entire volume of trapped air at the point when capillary and pressure forces balance. Equally, a chamber or other microfluidic structure may be provided at the end of the first conduit in order to contain the required volume of air.

Similarly, the second conduit, in some embodiments, is not vented. In this case, liquid will flow along the second conduit and as it does so, the pressure of the volume of air at the end of the second conduit will increase. Eventually, capillary forces acting on the liquid in the second conduit will balanced by the pressure of this trapped gas and flow of liquid along the second conduit will stop. As will be appreciated, this is not necessarily problematic if liquid is able to flow as far down the second conduit as is required for the application in question.

The invention claimed is:

1. A microfluidic device comprising:

a supply reservoir;

a first vented conduit in fluidic communication with the supply reservoir such that liquid flows by capillary effect from the supply reservoir into the first conduit; and a second unvented conduit connected to the first vented conduit through an opening in a wall of the first vented conduit and configured such that liquid flows from the first vented conduit to the second unvented conduit by capillary effect;

wherein a width of the second unvented conduit, along a direction of liquid flow in the first vented conduit, is greater than a depth of the second unvented conduit; and wherein the depth of the second unvented conduit is less than a depth of the first vented conduit.

2. A device as claimed in claim 1, further comprising:

a first vent structure comprising an air channel connecting the first vented conduit to the supply reservoir, the first vent structure enabling gas in the first vented conduit displaced by flow of liquid from the supply reservoir into the first vented conduit to escape from the first vented conduit and into the supply reservoir.

3. A device as claimed in claim 1, wherein a ratio of a depth of the first vented conduit upstream of a junction between the first vented conduit and second unvented conduit to the depth of the second unvented conduit is greater than or equal to 3.

4. A device as claimed in claim 1, wherein the first vented conduit comprises a surface tension barrier downstream of a junction between the first vented conduit and second unvented conduit.

5. A device as claimed in claim 1, wherein a portion of the first vented conduit downstream of a junction between the first vented conduit and second unvented conduit has a transverse dimension greater than a depth of the first vented conduit upstream of the junction between the first vented conduit and second unvented conduit.

6. A device as claimed in claim 5, wherein a ratio of the depth of the first vented conduit upstream of the junction between the first vented conduit and second unvented conduit to a depth of the aforesaid portion of the first vented conduit downstream of the junction between the first vented conduit and second unvented conduit is less than or equal to 0.75.

7. A device as claimed in claim 1, wherein a portion of the first vented conduit downstream of a junction between the first vented conduit and second unvented conduit has a depth greater than a depth of the first vented conduit upstream of the junction between the first vented conduit and second unvented conduit.

8. A device as claimed in claim 1, wherein a depth decrease from the first vented conduit to the second unvented conduit is configured as a step.

9. A device as claimed in claim 1, wherein a ratio of the width of the second unvented conduit to the depth of the second unvented conduit is greater than or equal to 42.5.

10. A device as claimed in claim 1, wherein at least one of the first vented conduit and second unvented conduit contains a dry reagent.

11. A device as claimed in claim 1, wherein the second unvented conduit is configured as a detection conduit to allow liquid to be imaged as it flows through the second unvented conduit.

12. A device as claimed in claim 11, wherein a wall of the second unvented conduit is substantially transparent.

13. A device as claimed in claim 1, wherein the second unvented conduit is substantially perpendicular to the first vented conduit.

* * * * *